US005522595A

United States Patent [19]

Wong

[11] Patent Number: 5,522,595

[45] Date of Patent: Jun. 4, 1996

[54] METHOD OF PLAYING A WAGERING GAME

[76] Inventor: Celia Wong, 1042 Whispering Oaks, Arcadia, Calif. 91006

[21] Appl. No.: 376,427

[22] Filed: Jan. 23, 1995

[51] Int. Cl.[6] ..... A63F 1/00

[52] U.S. Cl. ..... 273/292

[58] Field of Search ..... 273/309, 274, 273/292

[56] References Cited

U.S. PATENT DOCUMENTS 5,013,049 5/1991 Tomaszewski ..... 273/292

5,397,128 3/1995 Hesse et al. ..... 273/292

*Primary Examiner*—Benjamin H. Layno

*Attorney, Agent, or Firm*—Timothy T. Tyson; Freilich, Hornbaker & Rosen

[57] ABSTRACT

A method of playing a wagering game 20 wherein wagers 100 are apportioned between a plurality of game players and a player-banker. Play includes the placing of wagers 100 by the players, and the establishment of a bank by the player-dealer. Each player and the player-banker are dealt three playing tiles 106 from which they select the highest ranking two tile hand. The player-banker then sequentially compares his/her hand with each of the player's hands and pays or takes the wager 100 depending upon whether the player's hand is higher ranking than the player-banker's hand.

20 Claims, 6 Drawing Sheets

METHOD OF PLAYING A WAGERING GAME

TECHNICAL FIELD

The present invention pertains generally to games and more particularly to a wagering game utilizing tiles having characters disposed thereon.

BACKGROUND ART

Wagering games employing tiles having characters have been known in the art for many years. The ancient Chinese game of Mah Jongg (Majong) is typically played with 152 tiles shaped like small dominoes and engraved or painted with Chinese designs and Western numerals. Another more contemporary game currently being played internationally, and specifically in Macau, is called Machop. Machop use 20 Majong-type tiles in a game wherein each of ten players receives two tiles. If the player's tiles outrank the tiles of a player-banker, then the player wins, otherwise the player-banker wins. A form of Machop called "China-Dominoes" developed by Mien is played in casinos in Southern California.

The present invention uses 12 different Majong tiles in either 24 or 32 tile sets to implement a wagering game which is totally different in both concept and playing methodology from Majong. The present invention also departs substantially from Machop in that a different number of total tiles are employed, both eight and ten player versions are possible, the players initially receive three vs. two tiles, a different playing format is utilized, and an element of player skill is introduced.

DISCLOSURE OF INVENTION

The present invention is directed to a wagering game which is played between a plurality of players and a revolving player-banker, and includes a dealer and a set of playing tiles each having a character disposed upon its surface. Either 24 or 32 playing tiles may be utilized, and the game may be played by either a maximum of seven players plus the player-banker or a maximum of nine players plus the player-banker. The game incorporates an element of skill by allowing the players and the player-banker each to select the highest ranking two tile hand from an initial three tile deal.

In accordance with a preferred embodiment of the invention, the players place wagers in accordance with a predetermined table minimum and maximum. The player-banker, who plays against all of the players, places a wager which forms the bank. The bank is usually the sum of all of the wagers of the players.

In accordance with another preferred embodiment of the invention, an "action" position is determined for each hand by lot. The action position is the playing position wherein the resolution of the wagers is first determined.

In accordance with another preferred embodiment of the invention, the dealer distributes three tiles to each of the players and the player-banker. The players and the player-banker select the highest ranking two-tile hand from the three dealt tiles and discard the unwanted tile.

In accordance with another preferred embodiment of the invention, the player-banker exposes his/her hand and then the action position player exposes his/her hand. The player-banker compares his/her hand with the action position player's hand and pays the wager amount to the action position player if the action position player's hand is higher ranking than that of the player-banker. Conversely, if the action position player's hand is not higher ranking than the player-banker's hand, the player-banker takes the wager. This process is then repeated for each player sequentially around the table.

In accordance with an important aspect of the invention, twelve different types of tiles are utilized in the 24 tile playing format and eleven different types of tiles are utilized in the 32 tile playing format. The tiles are equivalent to selected tiles from the well known game of Majong. Nine of the tiles comprise the numbers one through nine having their face numeric value, and the remaining tiles constitute special Majong characters each having a numeric value of zero.

In accordance with an important feature of the invention, the tiles are ranked starting with the character tiles as the highest and ranging downward nine through one.

In accordance with another important aspect of the invention, hands are ranked starting with the highest ranking pair and ranging downward by decreasing hand numeric total.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1A:
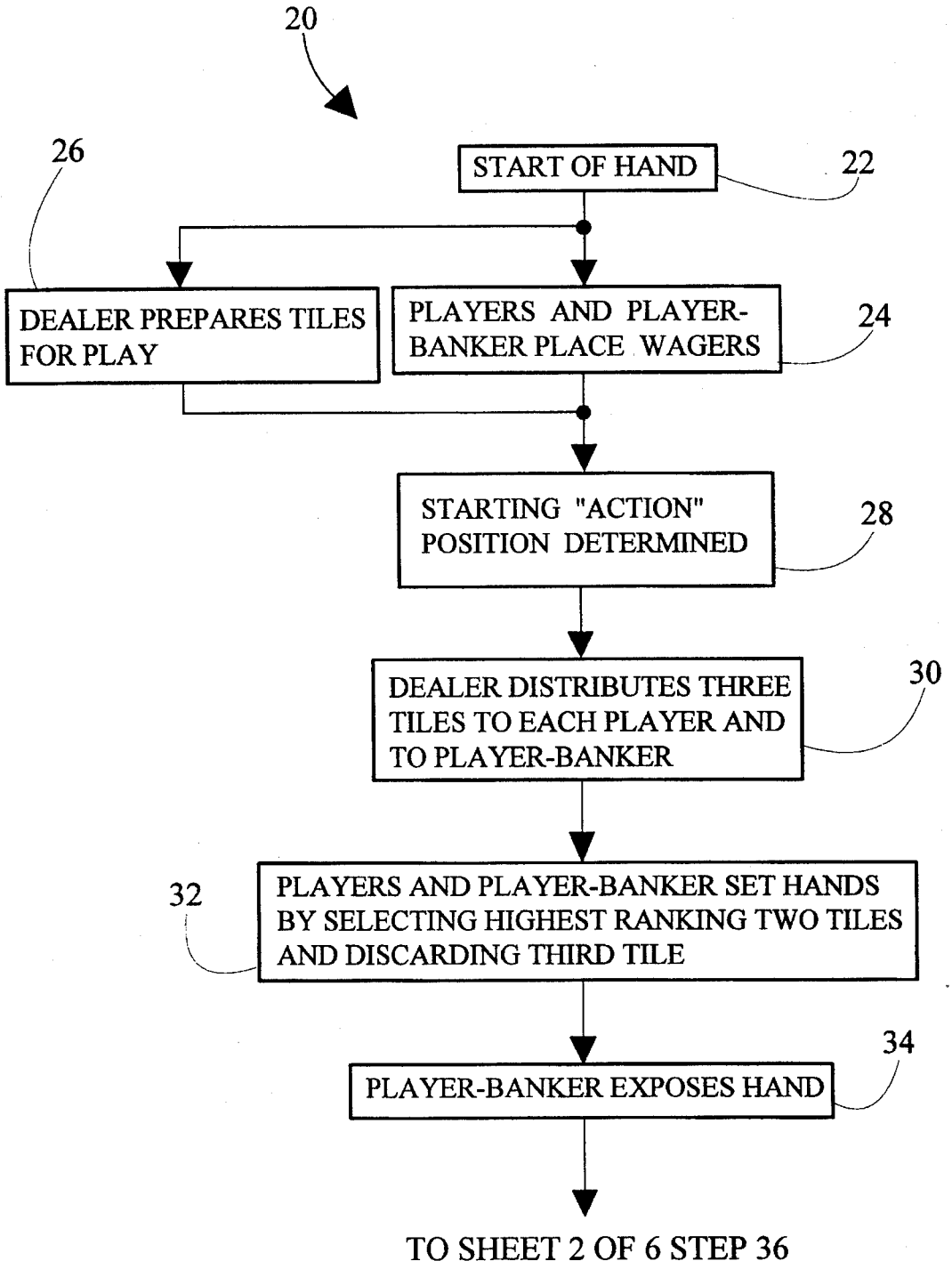
FIG. 1 is a flow diagram illustrating the steps and method of play of a game in accordance with the present invention, generally designated as 20.
Figure 1B:
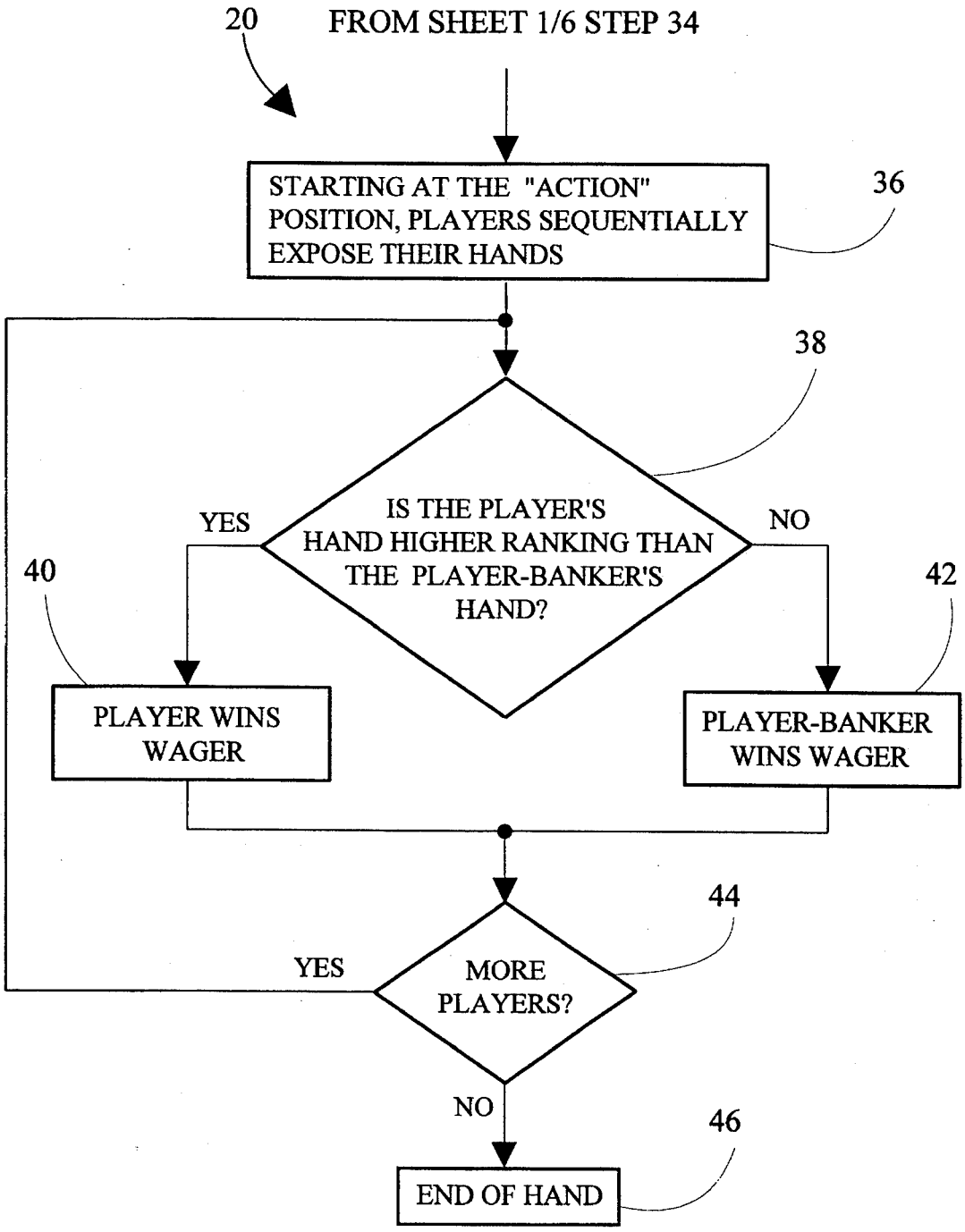

Referring initially to FIG. 1, there is depicted a flow diagram illustrating the steps and method of playing a wagering game wherein wagers are apportioned between a plurality of game players and a player-banker in accordance with the present invention, generally designated as 20. The game comprises a plurality of players, a player-banker, a dealer, a set of playing tiles, each tile having one of a plurality of characters disposed thereon. The game is especially suited for play at a casino or other gaming establishment wherein the dealer is in the employ of the casino or house. A hand begins with start terminator step 22. In step 24 the dealer calls for wagers 100 and the players and the player-banker place wagers 100 in betting areas 102 directly in front of their playing positions 103 on playing table 104 (refer to FIG. 2). In accordance with a preferred feature of the game, the wagers 100 must fall within a predetermined minimum and maximum which is established by the casino (for example, $25 and $300, or $50 and $600, or $100 and $1,000, etc.). The wager 100 of the player-banker differs in concept from those of the other players. In that all players play against the player banker, the player banker's wager 100 forms a bank and will normally be much greater than the wagers 100 of the other players, and in fact will usually be equal to the sum of the wagers 100 of all of the players. This is called "covering the table". In the example shown in FIG. 2, the player-banker occupies playing position 2 and has wagered an amount of 25 chips forming a bank which exactly equals the sum of the wagers of all the other players. The role of player-banker rotates sequentially one position around the playing table 104 at the conclusion of each hand so that periodically each player becomes the player-banker. In a preferred playing embodiment, the player-banker can win or lose no more than his/her wager 100. Therefore, if the player-banker's wager 100 is less than the sum of the wagers 100 of all the other players, it is possible that some of the players will not have their wagers 100 resolved during the course of the hand (refer to the discussion of FIG. 4 below). While the player-banker format is a preferred embodiment of the present invention, it is also possible for the players to play the game against the dealer without having a player-banker. Additionally, in another embodiment of wagering step 24 the players and the player-banker also contribute a predetermined collection amount to the dealer. When the present game is played in a casino or other gaming establishment, this collection constitutes payment for the cost of conducting the game and includes a profit for the casino.

In step 26 the dealer prepares the playing tiles 106 (refer to FIG. 3) for play. This step can include shuffling the tiles 106 by placing them face down on the playing table 104 and moving them about, stacking the tiles 106 in preparation for distribution, and cutting the tiles 106 by modifying the stacking arrangement. The present invention has two preferred sets of playing tile embodiments, one set having 24 individual playing tiles 106 and the other set having 32 individual playing tiles 106. The 24 tile 106 version can be played by a maximum of 7 players plus a player-banker, and the 32 tile 106 version can be played by a maximum of 9 players plus a player-banker. In the 24 tile 106 version twelve different tile 106 types (refer to FIG. 3) are utilized each type having a different character disposed upon its surface. In the 32 tile version eleven tile 106 types are utilized. In a preferred embodiment, the characters are engraved so that they can be sensed by touch.

Figure 3:
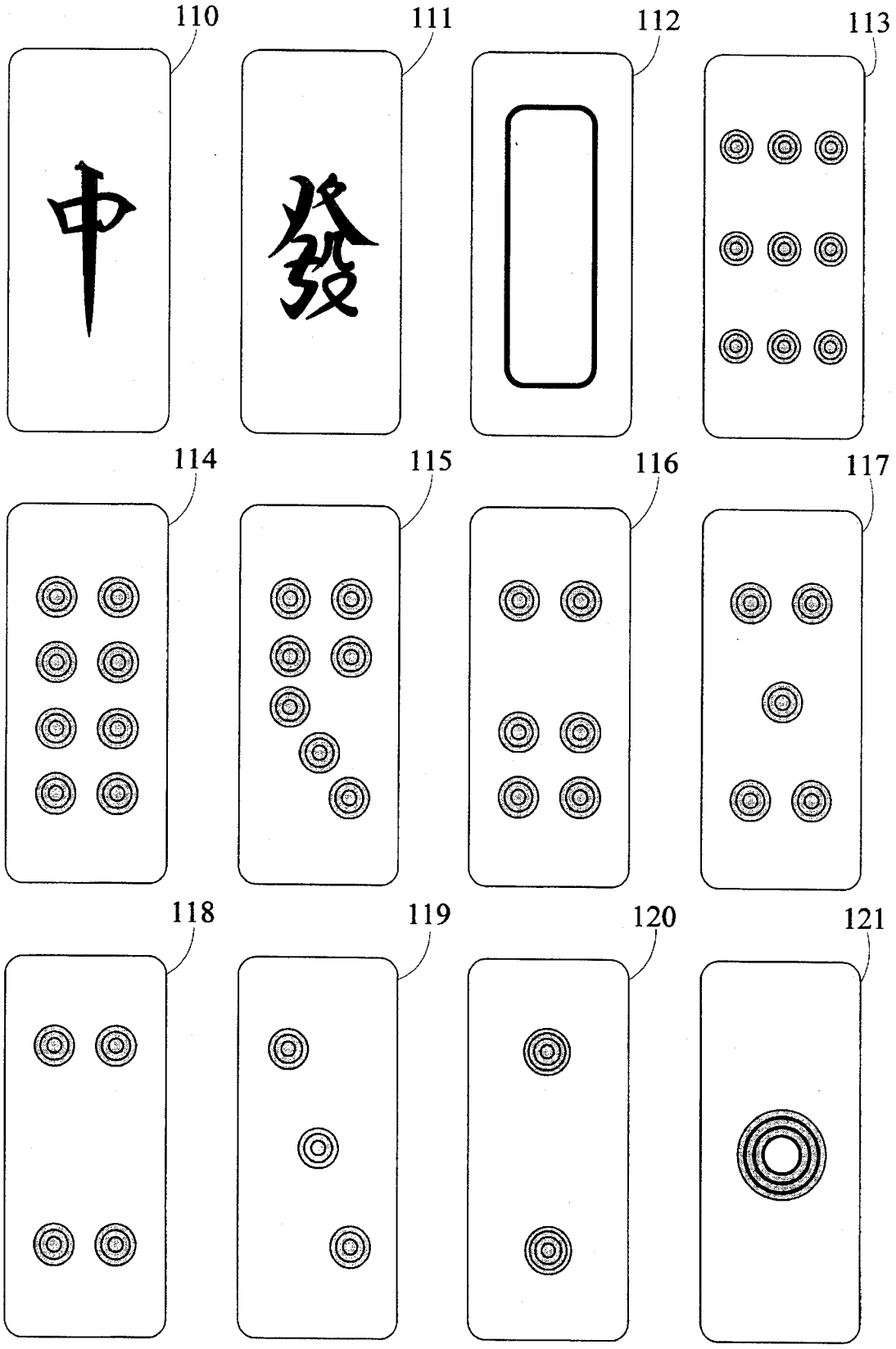
FIG. 3 is a plan view of the playing tiles show in order of descending rank.

Referring to FIG. 3 the twelve tile 106 types in order of descending rank are:

a first character tile 110 (not used in the 32 tile 106 version) having a numeric value of zero;

a second character tile 111 having a numeric value of zero;

a third character tile 112 having a numeric value of zero;

a number nine tile 113 having a numeric value of nine;

a number eight tile 114 having a numeric value of eight;

a number seven tile 115 having a numeric value of seven;

a number six tile 116 having a numeric value of six;

a number five tile 117 having a numeric value of five;

a number four tile 118 having a numeric value of four;

a number three tile 119 having a numeric value of three;

a number two tile 120 having a numeric value of two; and, a number one tile 121 having a numeric value of one.

In a preferred embodiment, the first character tile 110 is equivalent to a Majong red character tile, the second character tile 111 is equivalent to a Majong green character tile, and the third character tile 112 is equivalent to a Majong blank tile.

In the 24 tile 106 version, the composition of the set of 24 playing tiles is as follows:

two first character tiles 110;
two second character tiles 111;
two third character tiles 112;
two number nine tiles 113;
two number eight tiles 114;
two number seven tiles 115;
two number six tiles 116;
two number five tiles 117;
two number four tiles 118;
two number three tiles 119;
two number two tiles 120; and,
two number one tiles 121.

In the 32 tile 106 version, the composition of the set of 32 playing tiles is as follows:

two second character tiles 111;
three third character tiles 112;
three number nine tiles 113;
three number eight tiles 114;
three number seven tiles 115;
three number six tiles 116;
three number five tiles 117;
three number four tiles 118;
three number three tiles 119;
three number two tiles 120; and,
three number one tiles 121.

Figure 2:
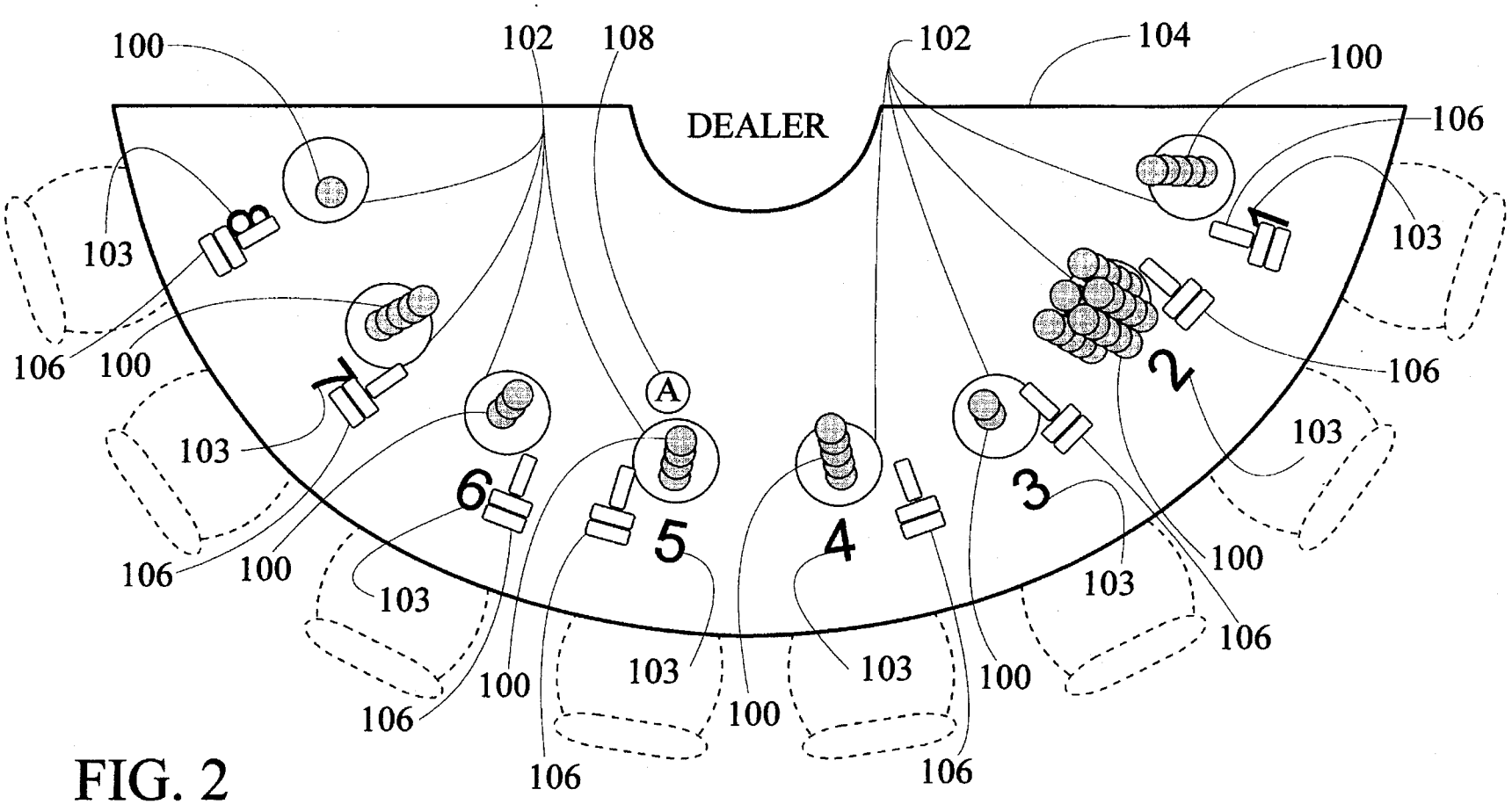
FIG. 2 is a plan view of an eight position playing table layout.

Returning to FIG. 1, in step 28 the starting or "action" position is determined. The action position is the playing position 103 (refer to FIG. 2) occupied by one of the players where the resolution of wagers commences for the hand (refer to steps 36 and 38 below). In FIG. 2 the action position is denoted by an action button 108 which for the depicted hand resides in front of player number 5. In a preferred embodiment, the dealer determines the action position by lot using dice, a dice cup, and a dice saucer. However, it would be possible to replace the dice with cards, a spinning pointer, numbered tokens, etc. Also, the action position could simply sequentially rotate around the table with each hand.

In step 30 the dealer distributes (deals) three tiles 106 (refer to FIG. 3) face down to each player and to the player-banker.

In step 32 the players and the player-banker each select two tiles 106 (refer to FIG. 3) to form a hand which has a ranking and discard the third tile 106. The discarded tile 106 is longitudinally oriented toward the dealer (refer to FIG. 2). In descending order, the two-tile hands are ranked as follows: (refer to FIG. 3.)

a pair of first character tiles 110;
a pair of second character tiles 111;
a pair of third character tiles 112;
a pair of number nine tiles 113;
a pair of number eight tiles 114;
a pair of number seven tiles 115;
a pair of number six tiles 116;
a pair of number five tiles 117;
a pair of number four tiles 118;
a pair of number three tiles 119;
a pair of number two tiles 120;
a pair of number one tiles 121;
hand totaling nine;
hand totaling eight;
hand totaling seven;
hand totaling six;
hand totaling five;
hand totaling four;
hand totaling three;
hand totaling two; and,
hand totaling one.

For the non-pair hands, the numeric value of the two tiles 108 are summed with the hand total comprising the least significant digit of the sum. For example, a hand composed of a number seven tile 115 and a number eight tile would have a total of five (7+8=15). Similarly, a hand composed of a first character tile 110 and a number four tile 118 would have a total of four (0+4=4). In an alternative hand ranking embodiment, when at least two players have the same total, the player with the highest ranking tile 106 has the higher ranking hand. For example, a hand composed of a number three tile 119 and an number six tile 116 has a total of nine (3+6=9). However, a hand composed of a number one tile 121 and a number eight tile 114 also has a total of nine (1+8=9). In this case the hand containing the number one tile 121 and the number eight tile 114 is higher ranking since the highest tile 106 in the hand, the number eight tile 114, is higher than either of the two tiles 106 in the other hand.

In step 34 the player-banker exposes his/her hand by turning the tiles 106 face up.

In step 36 the player occupying the action position exposes his/her hand by turning the tiles 106 face up.

In step 38 the player-banker compares the action position player's hand with his/her hand. In step 40 the player-banker distributes an amount equal to the action position player's wager 100 (refer to FIG. 2) to the action position player if the action portion player's hand is higher ranking than his/her hand. Else, in step 42 the player-banker takes the wager 100 of the action position player if the action position player's hand is not higher ranking than his/her hand. The comparing, and distributing or taking of steps 38 an 40 or 42 is then sequentially performed with each player until there are no more players as determined in step 44.

The game then proceeds to end terminator step 46 and the hand is concluded.

FIG. 2 is a plan view of an eight position playing table layout showing wagers 100, betting areas 102, playing positions 103, playing table 104, playing tiles 106, and action button 108. In the shown embodiment, the player-banker occupies playing position 2 and the action button 108 is at playing position 5.

FIG. 3 is a plan view of the playing tiles 106 shown in order of descending rank. The tiles are the first or red character tile 110, the second or green character tile 111, the third or blank character tile 112, and the number nine through number one tiles 113 through 121 respectively.

Figure 4:
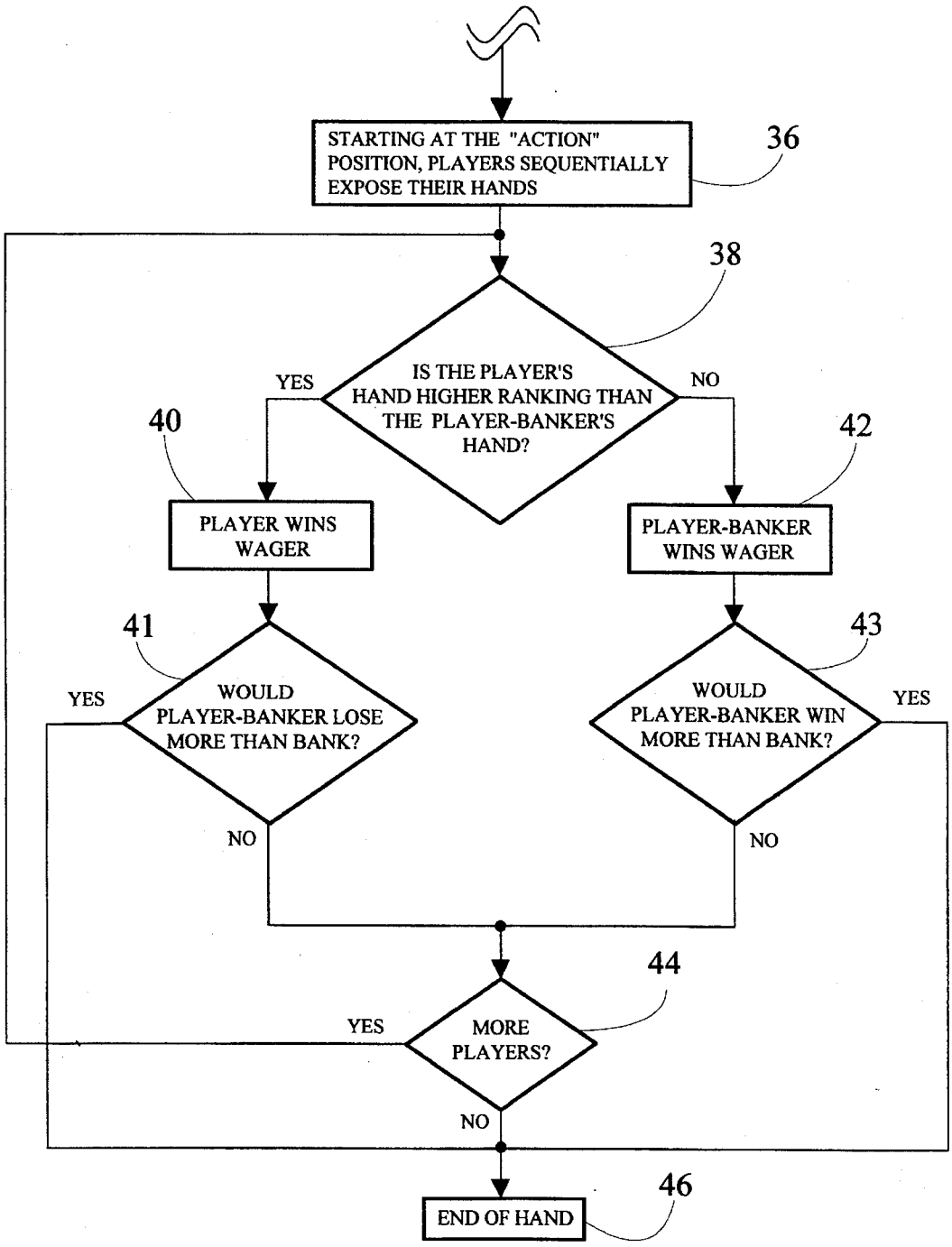
FIG. 4 is a flow diagram illustrating the steps and method of play when the bank is less than the sum of the players wagers; and, FIG. 5 is a plan view of a ten position playing table layout.

FIG. 4 is a flow diagram illustrating the steps and method of play when the bank is less than the sum of the player's wagers. Steps 36, 38, 40, 42, 44, and 46 are as previously described under the discussion of FIG. 1. Additional decision steps 41 and 43 accommodate an insufficient bank situation for a losing and winning player-banker respectively. For example, assume that there are five players plus the player-banker in the game and that they have made the following wagers:

| | |
|---|---|
| action position player: | $30 |
| player 2 | $40 |
| player 3 | $20 |
| player 4 | $25 |
| player 5 | $35 |
| Sum of Player's Wagers | $150 |
| player-banker's wager | $100 |

It is observed that the player-banker's wager (the bank) is less than the sum of the player's wagers. Now, further assume that the player-banker's hand is lower ranking than all five of the players. Starting at the action position play would proceed according to steps 36, 38, and 40. In step 41 the answer to the question would be no since the player-banker has only lost $30 to the action position player. Play would then continue according to steps 44, 38, 40, and 41 for player 2. The answer to the question in step 41 would still be no since the player-banker has now only lost $30+$40=$70 (which is less than the $100 bank). Play would then continue according to steps 44, 38, 40, and 41 for player 3. The answer to the question in step 41 would still be no since the player-banker has now only lost $30+$40+$20=$90. Play would then continue according to steps 44, 38, 40, and 41 for player 4. Now however the answer to the question in step 41 is yes since the player-banker would now have lost $30+$40+$20+$25=$115. In this situation, the player-banker pays player 4 all that remains in the bank ($10) and the hand is concluded. It is noted that player 5 does not win even though his/her hand outranks that of the player-dealer. A similar situation, controlled by step 43, exists when the player-banker would win more than is in the bank.

Figure 5:
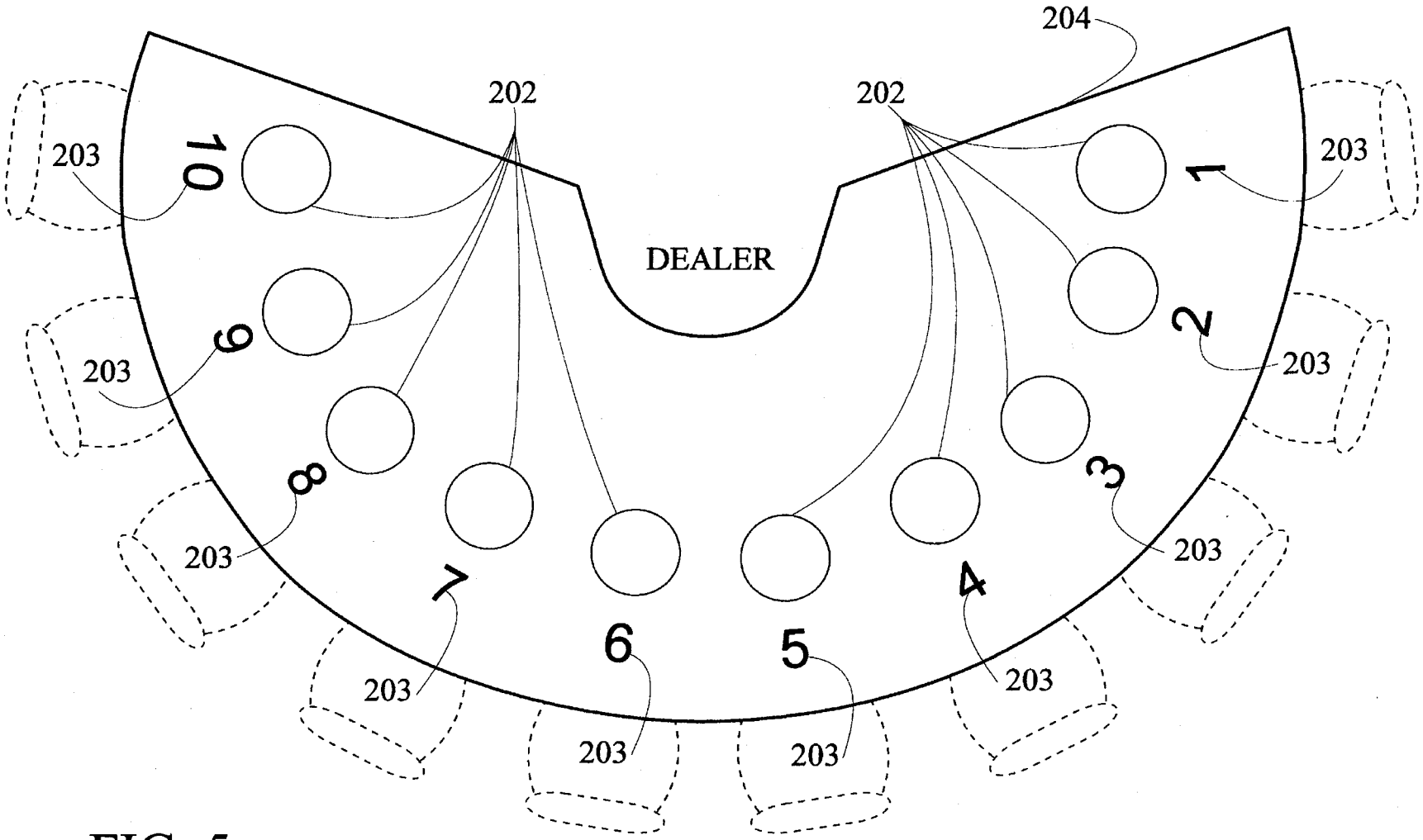

FIG. 5. is a plan view of a ten position playing table layout showing the betting areas 202, playing positions 203, and playing table 204.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. A method of apportioning wagers between a plurality of game players and a player-banker, comprising the steps of:

providing said plurality of players, said player-banker, a dealer, and a set of playing tiles, each tile having one of a plurality of characters disposed thereon, said characters including a plurality of different numerical characters and a plurality of different non-numeric characters;

said players each placing a wager;

said player-banker placing a wager forming a bank;

determining an action position occupied by one of said players;

said dealer distributing a total of only three tiles to each player and to said player-banker with no other tiles being dealt;

said player and said player-banker each examining their three tiles and from their three tiles selecting two tiles forming a two tile hand and discarding the third non-selected tile without drawing any additional tiles;

each said two tile hand comprising one of a) tiles having matching said non-numerical characters, b) tiles having matching said numerical characters, and c) two unequal tiles having a numeric value;

a ranking of said two tile hands comprising, hands having matching said non-numerical character tiles being first, hands having matching said numerical characters tiles being second, and hands having two unequal tiles having the highest said numeric value being third, wherein if two said two unequal tile hands each have said same highest numeric value, said hand having the highest ranking tile is ranked higher;

said player-banker exposing his/her hand;

said player occupying said action position exposing his/her hand;

said player-banker comparing said action position player's hand with said player-banker's hand and distributing an amount equal to said action position player's wager to said action position player if said action position player's hand is higher ranking than said player-banker's hand, else said player-banker taking said action position player's wager if said action position player's hand is not higher ranking than said player-banker's hand; and, said player-banker performing said steps of comparing and distributing or taking, sequentially with each player.

2. The method according to claim 1, wherein said plurality of game players plus said player-banker total to a maximum of eight.

3. The method according to claim 1, wherein said plurality of game players plus said player-banker total to a maximum of ten.

4. The method according to claim 1, wherein said set of playing tiles includes 24 individual tiles.

5. The method according to claim 4, wherein said set of playing tiles are of twelve types comprising in order of descending rank:

a first character tile having a numeric value of zero;

a second character tile having a numeric value of zero;

a third character tile having a numeric value of zero;

a number nine tile having a numeric value of nine;

a number eight tile having a numeric value of eight;

a number seven tile having a numeric value of seven;

a number six tile having a numeric value of six;

a number five tile having a numeric value of five;

a number four tile having a numeric value of four;

a number three tile having a numeric value of three;

a number two tile having a numeric value of two; and, a number one tile having a numeric value of one.

6. The method according to claim 5, said first, second, and third character tiles further comprising:

said first character tile equivalent to a Majong red character tile;

said second character tile equivalent to a Majong green character tile; and, said third character tile equivalent to a Majong blank tile.

7. The method according to claim 5, the composition of said set of playing tiles comprising:

two said first character tiles;

two said second character tiles;

two said third character tiles;

two said number nine tiles;

two said number eight tiles;

two said number seven tiles;

two said number six tiles;

two said number five tiles;

two said number four tiles;

two said number three tiles;

two said number two tiles; and, two said number one tiles.

8. The method according to claim 5, said ranking of said hands comprising in order of descending rank:

a pair of said first character tiles;

a pair of said second character tiles;

a pair of said third character tiles;

a pair of said number nine tiles;

a pair of said number eight tiles;

a pair of said number seven tiles;

a pair of said number six tiles;

a pair of said number five tiles;

a pair of said number four tiles;

a pair of said number three tiles;

a pair of said number two tiles;

a pair of said number one tiles;

said hand totaling nine;

said hand totaling eight;

said hand totaling seven;

said hand totaling six;

said hand totaling five;

said hand totaling four;

said hand totaling three;

said hand totaling two; and, said hand totaling one.

9. The method according to claim 8, wherein said totals comprise the least significant digit determined by summing the numeric value of said two tiles.

10. The method according to claim 8, wherein when at least two said players have said same total, said player with said highest ranking tile having said higher ranking hand.

11. The method according to claim 1, wherein said set of playing tiles includes 32 individual tiles.

12. The method according to claim 11, wherein said set of playing tiles are of eleven types comprising in order of descending rank:

a second character tile having a numeric value of zero;

a third character tile having a numeric value of zero;

a number nine tile having a numeric value of nine;

a number eight tile having a numeric value of eight;

a number seven tile having a numeric value of seven;

a number six tile having a numeric value of six;

a number five tile having a numeric value of five;

a number four tile having a numeric value of four;

a number three tile having a numeric value of three;

a number two tile having a numeric value of two; and, a number one tile having a numeric value of one.

13. The method according to claim 12, said first, second, and third character tiles further comprising:

said first character tile equivalent to a Majong red character tile;

said second character tile equivalent to a Majong green character tile; and, said third character tile equivalent to a Majong blank tile.

14. The method according to claim 12, the composition of said set of playing tiles comprising:

two said second character tiles;

three said third character tiles;

three said number nine tiles;

three said number eight tiles;

three said number seven tiles;

three said number six tiles;

three said number five tiles;

three said number four tiles;

three said number three tiles;

three said number two tiles; and, three said number one tiles.

15. The method according to claim 12, said ranking of said hands comprising in order of descending rank:

a pair of said second character tiles;

a pair of said third character tiles;

a pair of said number nine tiles;

a pair of said number eight tiles;
a pair of said number seven tiles;
a pair of said number six tiles;
a pair of said number five tiles;
a pair of said number four tiles;
a pair of said number three tiles;
a pair of said number two tiles;
a pair of said number one tiles;
said hand totaling nine;
said hand totaling eight;
said hand totaling seven;
said hand totaling six;
said hand totaling five;
said hand totaling four;
said hand totaling three;
said hand totaling two; and,
said hand totaling one.

16. The method according to claim 15, wherein said totals comprise the least significant digit determined by summing the numeric value of said two tiles.

17. The method according to claim 15, wherein when at least two said players have said same total, said player with said highest ranking tile having said higher ranking hand.

18. The method according to claim 1, said step of said dealer determining said action position further comprising:

said dealer using dice to effect said determination.

19. The method according to claim 1, further including the steps of:

said dealer shuffling said playing tiles;

said dealer stacking said playing tiles; and, said dealer cutting said playing tiles.

20. The method according to claim 1, further including the step of:

said players contributing a predetermined collection amount to said dealer.

* * * * *